US007827645B2

(12) United States Patent
Eklund et al.

(10) Patent No.: US 7,827,645 B2
(45) Date of Patent: Nov. 9, 2010

(54) FLOOR MAINTENANCE MACHINE

(75) Inventors: William R. Eklund, Springdale, AR (US); Emert R. Whitaker, Siloam Springs, AR (US)

(73) Assignee: Alto U.S. Inc., Springdale, AR (US)

( * ) Notice: Subject to any disclaimer, the term of this patent is extended or adjusted under 35 U.S.C. 154(b) by 1182 days.

(21) Appl. No.: 11/307,703

(22) Filed: Feb. 17, 2006

(65) Prior Publication Data

US 2007/0192973 A1 Aug. 23, 2007

(51) Int. Cl.
*A47L 11/30* (2006.01)

(52) U.S. Cl. ..... 15/50.1; 15/320

(58) Field of Classification Search ..... 15/50.1, 15/320

See application file for complete search history.

(56) References Cited

U.S. PATENT DOCUMENTS

| | | | | |
|---|---|---|---|---|
| 4,194,263 | A | 3/1980 | Herpers et al. | |
| 4,766,432 | A | 8/1988 | Field | |
| 5,098,506 | A * | 3/1992 | Brown et al. | 156/344 |
| 5,193,985 | A * | 3/1993 | Escue et al. | 417/53 |
| 6,042,656 | A * | 3/2000 | Knutson | 134/21 |
| 6,105,192 | A | 8/2000 | Deiterman et al. | |
| 6,301,738 | B1 | 10/2001 | Deiterman et al. | |
| 6,735,811 | B2 | 5/2004 | Field et al. | |
| 6,857,162 | B1 | 2/2005 | Rasmussen | |
| 2002/0042965 | A1 | 4/2002 | Salem et al. | |
| 2003/0070697 | A1 | 4/2003 | Field et al. | |
| 2003/0135952 | A1 | 7/2003 | Coates et al. | |
| 2003/0217421 | A1 * | 11/2003 | Besel | 15/50.1 |
| 2004/0187895 | A1 * | 9/2004 | Field et al. | 134/26 |
| 2005/0028316 | A1 | 2/2005 | Thomas, Sr. et al. | |
| 2005/0178410 | A1 | 8/2005 | Levy | |
| 2005/0217062 | A1 | 10/2005 | Field et al. | |

* cited by examiner

*Primary Examiner*—Shay L Karls
(74) *Attorney, Agent, or Firm*—Oppenheimer Wolff & Donnelly LLP

(57) ABSTRACT

A floor maintenance machine is provided. The machine can be used to clean hard or soft floors. A cleaning fluid is dispensed by a dispensing system containing at least two reservoirs, one for a diluting bulk fluid and another for cleaner concentrate. The dispensing system effects both a controlled ratio of bulk fluid to cleaner concentrate and the rate of cleaning solution dispensed for cleaning.

21 Claims, 2 Drawing Sheets

FLOOR MAINTENANCE MACHINE

BACKGROUND OF THE INVENTION

Floor maintenance machines are well known in the industry and are used for cleaning floors as by scrubbing. Examples of such machines are available from Clarke and Nilfisk-Advance. The maintenance machines generally include a tank for a cleaning solution, a cleaning device which may be an orbitally moving or rotating brush or scrubbing pad mounted on an assembly for moving the machine about a floor. The brush or pad may move about a vertical or horizontal axis. A power drive device may be provided to propel the maintenance machine while cleaning fluid solution is dispensed onto the floor adjacent the cleaning device. The cleaning solution may be removed from the floor with a recovery system that can include a squeegee and vacuum that will move recovered cleaning solution to a storage tank for later disposal. Such machines can either be a walk behind or riding type machine and can clean a path typically about 15 inches to about 48 inches wide. The walk behind machines may be a push type or a driven type as is well known in the art.

One of the issues with such machines is the uniform dispensing of cleaning fluid onto the floor. This can be both by the rate of dispensing and by the ratio of cleaning chemicals to water. The cleaning solution formed by the combination water (a typical bulk diluting fluid) and cleaning chemicals and can be either a liquid and/or foam. One early solution to the ratio of water to cleaning chemicals, was the use of a pre-mix. However, this was expensive since water had to be shipped while water was locally available and it did not allow for easy customization of the cleaning fluid for a particular job. One solution to this latter problem is mixing the water of the cleaning solution with the chemicals of the cleaning solution on site. However, this can be problematic because of the skill level of the machine operators plus, once mixed, the ratios may not be changed easily when in the storage tanks on the maintenance machine to change cleaning solutions though requires emptying of the storage tank. Another solution to the problem is to mix the water and chemicals together on the cleaning machine by introducing the chemicals into the water prior to dispensing to the floor to be cleaned.

There is thus a need, for an improved floor maintenance machine that will allow mixing of the cleaning bulk liquid and concentrated chemicals on the maintenance machine during operation thereof to provide accurate control of the final ratio of water to added cleaning chemicals and the rate of dispensing to the floor.

SUMMARY OF INVENTION

The present invention involves the provision of both a method and apparatus that will effect mixing of one or more cleaning chemicals with a diluting fluid on a floor maintenance machine during machine operation.

The present invention involves the provision of a floor maintenance machine that utilizes separate sources of a bulk diluting fluid like water and one or more cleaning enhancement chemicals and provides a mixing system for effecting a controlled ratio mixture of fluid and cleaning chemical to form a cleaning solution and allows for the adjustment of the ratio of cleaning chemical to fluid by a machine operator. The system also permits for the adjustment of the amount of cleaning solution dispensed to the floor in a given amount of time. The maintenance machine includes a cleaning device, for example, a scrubber, at least two storage reservoirs connected in flow communication by respective outlet conduit portions of a conduit system. A pump is provided for pumping the cleaning chemical into the conduit system on a predetermined controlled basis as controlled by a controller. A discharge flow control device is provided for controlling the amount of cleaning solution dispensed to the floor adjacent the cleaning device. The operation of the flow control device is also controlled by a controller. A level sensor can be provided for monitoring the level (pressure head) of diluting fluid in its storage tank. Signals from the level sensor and the flow control device may be used to control operation of the pump and/or the flow control device. The signal from the level sensor can be used to control operation of the flow control device to provide a uniform flow at all head pressures.

The present invention also involves the provision of a method of maintaining a floor using a cleaning device having a cleaning solution fluid dispensed adjacent to the cleaning device. The cleaning solution is comprised of at least two components, a bulk diluting fluid like water and one or more cleaning chemicals which are dispensed from separate reservoirs carried by a maintenance machine. The cleaning chemical is pumped to mix it with the bulk fluid in a controlled ratio. Operation of the pump and a discharge flow control device are controlled by a controller system which permits dispensing of a mixed cleaning solution of combined cleaning chemical(s) and bulk fluid at a desired ratio and at a desired flow rate of dispensing of cleaning solution components.

BRIEF DESCRIPTION OF THE DRAWINGS

Like numbers throughout the various Figures designate like or similar parts or construction.

DETAILED DESCRIPTION

Figure 1:
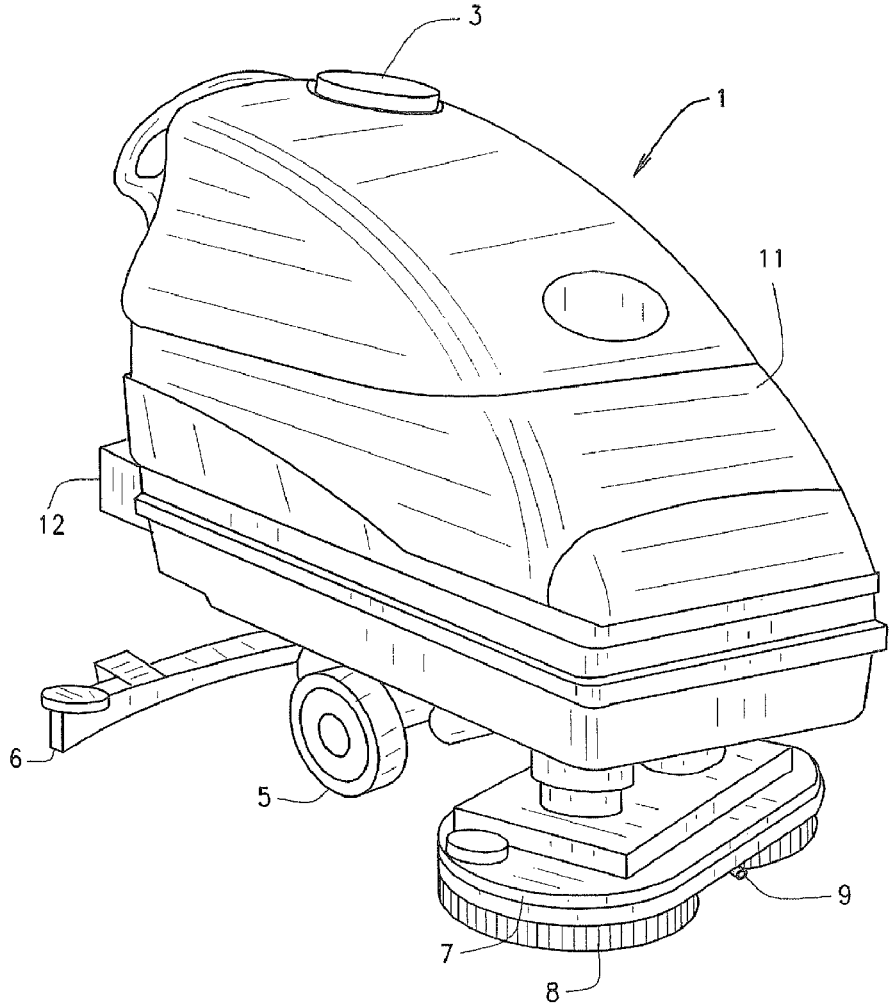
FIG. 1 is a schematic illustration of a system for mixing and dispensing cleaning fluid to a cleaning device for cleaning floors.
Figure 2:
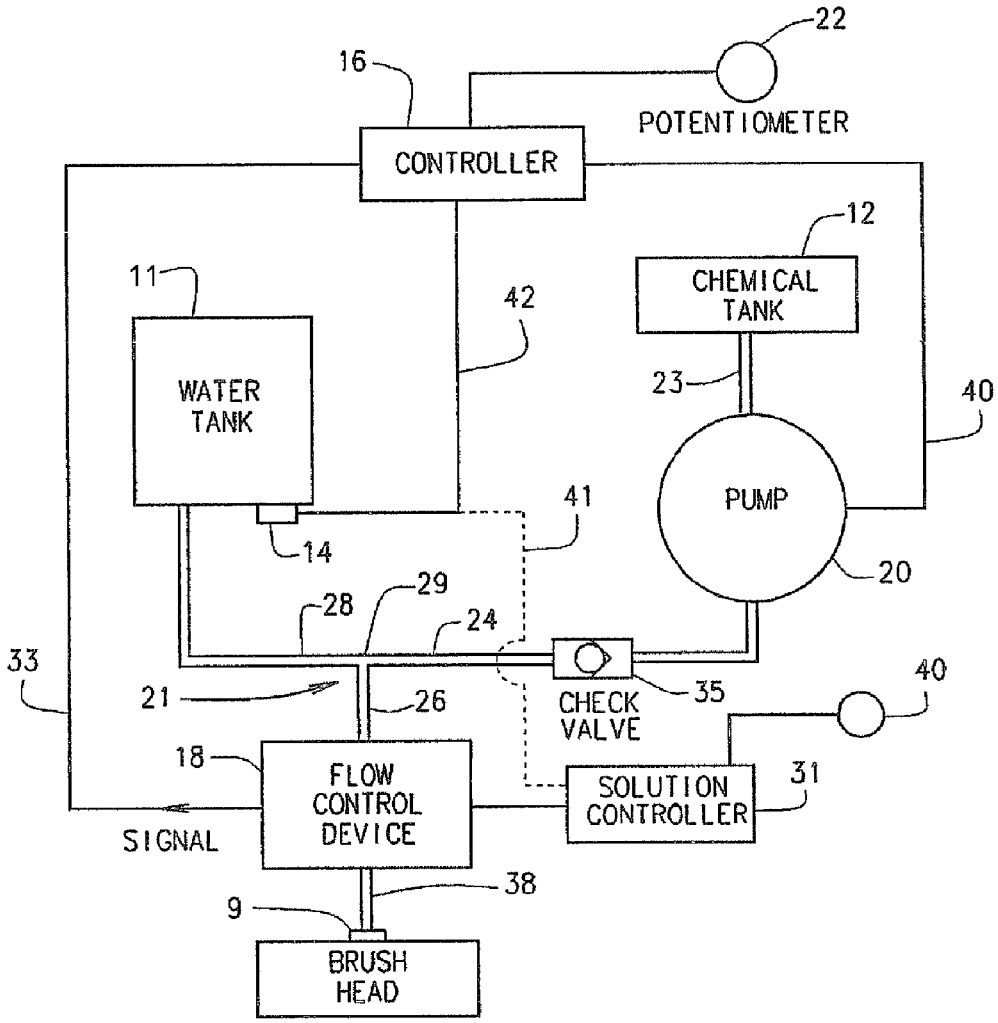
FIG. 2 is a perspective view of a floor maintenance machine.

The referenced numeral 1 designates generally a floor maintenance machine. The machine 1 may be driven by a power source (not shown) and typically rides on three or more wheels 5 at least one of which may be driven by the power source. The machine 1 may also be manually propelled. The wheels 5 are positioned at appropriate locations on the lowermost portion of the machine 1 and preferably at least one of the wheels 5 is steerable to help direct the motion of the machine 1. Such machines are well known in the industry and may be typified by the Focus and Boost models as provided by Clarke of Springdale, Ark. Such machines may be a walk behind machine or a machine that can be ridden by an operator. In a preferred embodiment, the machine 1 is constructed to clean what are referred to as soft, textured, smooth or hard floors for example carpet, linoleum, concrete, tile, wood and vinyl floors. In such an apparatus, the machine 1 can also include a recovery system having one or more squeegees 6, a storage tank or reservoir 3 and a vacuum pick up system to help remove used cleaning solution from the floor and temporarily store it for later discharge. The machine 1 will also include a cleaning device 7 used to contact the floor to scrub the floor. The cleaning device 7 can include one or more scrubbers 8 such as bristle brushes or a fibrous pads or the like depending on the type of floor to be cleaned, the cleaning solution used as well as the amount of and type of dirt on the floor. A scrubber 8 may move about a generally vertical or horizontal axis. The machine 1 includes a cleaning fluid dispenser 9 positioned adjacent to the cleaning device 7 to discharge cleaning fluid onto the floor and/or a scrubber 8 to help in the cleaning process. The dispenser 9 can include one or more discharge nozzles or outlets and may include a dispensing manifold as is known in the art. The machine 1 will carry the various components illustrated in FIG. 1 and in a particularly preferred embodiment the three reservoirs 3, 11 and 12. The reservoir 11 is for a first cleaning solution component which is preferably a bulk diluting fluid, for example, water. The reservoir, 12, is for the storage of another component of a cleaning solution for example, cleaning chemicals such as soaps, detergents, enzymes, surfactants and blends thereof. Because the cleaning chemicals are preferably concentrated and are to be diluted, the reservoir 12 can be significantly smaller than the reservoir 11. The reservoirs 11, 12 can be contained in a single unit, however, separate reservoirs are preferred. It is preferred that the reservoirs 11 and 12 be made of a polymeric material so as to be resistant to chemical degradation by the stored components, leak resistant and be relatively break resistant. Polyethylene and polypropylene are generally suitable polymeric materials.

In a preferred embodiment, a level sensor 14 is associated with the reservoir 11 and is operable to provide a signal indicative of the level (pressure head) of cleaning fluid contained within the reservoir 11. The signal can be used to regulate the open time of a flow control device 18 within a given time period so that even flow rate can be achieved from the reservoir 11. The level sensor 14 can be a pressure type sensor or any other suitable level sensor and can be mounted on the tank or can have a sensing element mounted on or integrated on the controller 16. A suitable sensor 14 is a 30 inch G-4V-mini from All Sensors.

The level sensor 14 is in turn connected to a controller 16 and/or 31 that is operable to receive a signal indicative of the level of fluid within the reservoir 11 and a signal from the flow control device 18 indicating its operation. The controller 16 may be any suitable controller such as a programmable logic controller (microprocessor) and may contain various look up tables to effect its operation and outputs in accordance with pre-programmed instructions. A suitable controller 16 is a Custom Control from Courtney Electronics. The controller 16 provides at least one output signal operable to control a pump 20 as discussed below. An adjustment device 22 such as a potentiometer is connected to or integrated with portions of the controller 16 and is operable to control the ratio of cleaning chemicals from the reservoir 12 to the cleaning fluid dispensed from the reservoir 11. The reservoir 12 is connected in fluid flow communication to the pump 20 via a conduit portion 23 of a conduit system designated generally 21. In turn, the pump 20 is connected in fluid flow communication with the conduit portion 26 and T-joint 29 via a conduit portion 24 of the system 21. The flow control device 18 is in turn connected in fluid flow communication to the conduit portion 24 via a conduit portion 26 as for example at a T-joint 29. The conduit portions 24, 26, 28 and check valve 35 may be an integral unit. The conduit portions 26, 38, the flow control device 18 and T 29 all may help effect mixing of the fluids from the reservoirs 11, 12. Mixing can also occur after the fluids are dispensed from the dispenser 9. It is to be noted that the fluids from the reservoirs 11, 12 can be dispensed in separate streams to the brush 8 and let the brush 8 effect mixing.

The flow control device 18 is operable to control the flow of combined fluids from the reservoirs 11, 12 to the dispenser 9. In a preferred embodiment, the flow control device 18 is a valve such as an on (open)/off (closed) valve but it is to be understood that a proportioning valve could also be used and amount of openness would be monitored. The device 18 can also be a pump, preferably a positive displacement pump like a piston pump or a peristaltic pump, a venturi pump or injection pump could also be used. The pump can function as a valve or include a valve. The operation of the flow control device 18 is effected by a controller 31 operably connected to the flow control device 18. In one embodiment, the controller 31 is operable to control the amount of time the valve (when the device 18 is an on/off valve) is in the open position and hence controls the amount of time that the valve is in the closed position. A suitable device 18 is a Deltrol DSVP10 solenoid valve. A signal is provided to the controller 16 via conductor 33 indicating the operation of the device 18 to the controller 16. The controller 31 may be provided with changeable time functions, as for example, by modules that may be substituted in the controller 31. A suitable controller 31 is a Custom Control from Courtney Electronics. The time functions may be selected and changed to control the cycle time of the device 18 in the case the device 18 is an on/off valve and change the degree of open if the device 18 is a proportioning valve. The controller 31 is operable to open and close an on/off valve at preset intervals, for example one second, five second and ten second cycle time intervals with a certain portion of the time interval having the valve open and the remainder of the portion of the cycle time, the valve is closed. The open time of the flow control device 18 can be regulated according to the signal received from the sensor 14. The open time of the device 18 would increase over a cycle or a longer time period as the fluid level in the reservoir 11 and the head pressure decrease. A signal indicating the operating condition of the device 18, for example, the time the device is open is transmitted to the controller 16 so the controller 16 can control operation of the pump 20 in accordance with programmed instructions. The pump 20 will preferably only be on (pumping) when the device 18 is open to help reduce pressure build up in the conduits 24, 26 and the pump 20. A check valve 35 may be provided in the conduit 24 between the pump 20 and the T 29 to prevent fluid from the reservoir 11 or in the conduit 24 or 26 from flowing back into the pump 20 and possibly the reservoir 12. The check valve 35 is preferably a low pressure valve, i.e., requires low pressure to open the valve from its closed position for example a 1 psi pressure differential across the check valve has been found acceptable for a breaking pressure. An acceptable valve 35 is a 426 Series 1 psi check valve from Specialty Mfg.

Fluid flows from the open device 18 through a conduit 38 to a dispenser 9 such as one or more nozzles adjacent the cleaning device 7 for dispensing of cleaning solution which is a combination of fluid from the reservoir 12 and fluid from the reservoir 11. Any one or all of the fluids may be a foam if desired but are preferably liquid at least until reaching dispenser 9.

The pump 20 is preferably of a metering type and more preferably of the positive displacement type for example a piston pump. The pump 20 could also be a venturi or injection type pump. The pump 20 is controlled in its operation by the controller 16 in response to input signals from the adjustment device 22, valve operation signal from the flow control device 18 and pre-programmed instructions. It is to be noted here, that the controller 31 and controller 16 may be integrated into a single unit if desired. The pump 20 is connected to the controller 16 via a conductor 40 wherein controlled electrical currents are transmitted from the controller 16 to the pump 20. The pump 20 includes both a pump device like a piston/cylinder and a power drive component like an electric motor or linear drive such as a solenoid.

In operation, the level sensor 14 is operable to provide signals to help maintain an appropriate ratio of cleaning fluid from the reservoir 12 to the diluting fluid like water which is gravity fed from the reservoir 11 for dispensing to the flow control device 18. The level sensor 14 is connected to the controller 16 as by conductor 42 and through the controller 16, controls the operation of the pump 20 preferably by controlling the pump in a frequency modulated operating format. In a preferred embodiment, the pump 20 will provide a metered amount during each on cycle for example one stroke of a piston in a cylinder, which may, for example, take 16 milliseconds to achieve. Then the pump 20 will be deactivated and be in an off mode until reenergized for another pump cycle. In a larger time frame perspective, the controller 16 is operable to control the number of strokes per unit of time for example strokes per minute that the pump 20 is providing fluid from the reservoir 12 to the conduit portion 24. An acceptable pump 20 is an EMS 10 piston pump from Clark Solutions. The adjustment device 22 may be adjusted from a preset setting to control the ratio of cleaning fluid in the reservoir 12 to water in the reservoir 11 by controlling the frequency of pulses of electrical current output, e.g., 1 HZ, 2 HZ, from the controller 16 to the pump 20. Thus, in a preferred embodiment the controller 16 controls the time between on cycles for the pump 20 with the duration of the energization of the pump being held at a fixed time, preferably, one discharge stroke of a piston in a cylinder. Operation signals from the controller 16 may be established by look up tables programmed in the controller 16. The output flow control device 18 is preferably an on/off valve and is controlled for its on time by the controller 31 which also controls the time that the valve 18 is closed. The valve operation may be changed by changing settings in the controller 31 as with an adjustment device 40 like a potentionmeter. The controller 16 receives a signal indicative of the operation of the device 18 via conductor 33 which signal can be from the device 18 or the controller 31 preferably indicating when the device 18 is open for flow. The controller 16 then energizes the pump 20 to pump at the frequency determined by the look up table in the controller 16 according to the setting of the adjuster 22. The construction of the invention avoids a problem of ratio control when the pump is operating at low frequency if the device 18 were only open for a short period of time by looking at operation over a long period of time relative to short operating times of the device 18 and pump 20. The controller 16 looks at the operation of the device 18 for its openness over time to operate the pump 20 at the appropriate frequency to provide the desired ratio of cleaner to diluting fluid. In an alternate embodiment, the level sensor 14 may provide a signal to the controller 31 via a conductor 41 to adjust operation of the flow controller 18 for the level of liquid in the reservoir 11, i.e., the higher the level of liquid, the shorter the time the valve 18 need be open to thereby achieve a more constant flow output to the dispenser 9.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A floor maintenance machine comprising:

a cleaning device for scrubbing contact with a floor;

a fluid feed conduit portion adapted to conduct fluid to the cleaning device;

a first reservoir;

a first fluid conduit portion connecting the first reservoir in fluid flow communication with the fluid feed conduit portion;

a second reservoir, the second reservoir being a gravity-feed reservoir;

a second conduit portion connecting the second reservoir in fluid flow communication with the fluid feed conduit portion;

a discharge flow control device connected in fluid flow communication with the fluid feed conduit portion and operable to control fluid flow to the cleaning device;

a pump connected in fluid flow communication with the first conduit portion and operable to pump a first fluid from the first reservoir to the fluid feed conduit portion;

a level sensor operable to continuously identify changes in fluid level within the second reservoir and to generate signals indicative of the identified changes in fluid level; and a controller operably connected to the flow control device, pump and level sensor and operable to control operation of the pump and the flow control device in response to the signals from the level sensor to provide a flow of fluid to the cleaning device at a substantially constant ratio of the first fluid from the first reservoir to a second fluid from the second reservoir for substantially all fluid levels of the second reservoir.

2. The floor maintenance machine as set forth in claim 1 wherein the controller includes a microprocessor.

3. The floor maintenance machine as set forth in claim 1 wherein the flow control device includes an on/off valve.

4. The floor maintenance machine as set forth in claim 3 wherein the pump includes a positive displacement pump.

5. The floor maintenance machine as set forth in claim 3 wherein the controller is operable to control the number of times the pump is activated for pumping in a period of time and the time period the pump is on for each pump on cycle.

6. The floor maintenance machine as set forth in claim 5 wherein the controller is operable to accumulate valve open time over a plurality of valve open cycles to effect controlled flow rates of fluids from the first and second reservoirs and activating a pump on cycle only if the valve is on.

7. The floor maintenance machine as set forth in claim 6 including a valve controller operably connected to the valve and operable to open the valve on a predetermined on/off cycle.

8. The floor maintenance machine as set forth in claim 7 wherein the valve controller is operable to provide different predetermined on/off cycles.

9. The floor maintenance machine as set forth in claim 1 wherein the flow control device includes a pump.

10. The floor maintenance machine as set forth in claim 1 wherein the fluid feed conduit portion is adapted to conduct fluid to a dispenser adjacent the cleaning device.

11. The floor maintenance machine as set forth in claim 10 wherein the discharge flow control device is operable to control fluid flow to the dispenser.

12. A floor maintenance machine comprising:

a cleaning device;

a fluid feed conduit portion adapted to conduct fluid to the cleaning device;

a first reservoir;

a first fluid conduit portion connecting the first reservoir in fluid flow communication with the fluid feed conduit portion;

a second gravity-feed reservoir;

a second conduit portion connecting the second reservoir in fluid flow communication with the fluid feed conduit portion;

a discharge flow control device connected in fluid flow communication with the fluid feed conduit portion and operable to control fluid flow to the cleaning device;

a pump connected in fluid flow communication with the first conduit portion and operable to pump a first fluid from the first reservoir to the fluid feed conduit portion;

a level sensor associated with the second reservoir, the level sensor operable to continuously indicate changes in fluid volume within the second reservoir and to generate signals indicative of the changes in fluid volume; and a controller operably connected to the flow control device, pump and level sensor, the controller operable to control operation of the pump and the flow control device based upon the signals from the level sensor to provide a substantially constant fluid flow to the cleaning device as the volume of fluid in the second reservoir changes.

13. A floor maintenance machine comprising:

a cleaning device for scrubbing contact with a floor;

a fluid feed conduit portion adapted to conduct fluid to the cleaning device;

a first reservoir;

a first fluid conduit portion connecting the first reservoir in fluid flow communication with the fluid feed conduit portion;

a second reservoir;

a second conduit portion connecting the second reservoir in fluid flow communication with the fluid feed conduit portion;

a discharge flow control device connected in fluid flow communication with the fluid feed conduit portion and operable to control fluid flow to the cleaning device;

a pump connected in fluid flow communication with the first conduit portion and operable to pump a first fluid from the first reservoir to the fluid feed conduit portion;

a level sensor operable to continuously identify changes in fluid level within the second reservoir as the fluid level decreases and to generate signals indicative of the identified changes in fluid level; and a controller operably connected to the flow control device, pump and level sensor and operable to control operation of the flow control device in response to the signals from the level sensor indicating the identified changes in the fluid level to provide a substantially uniform flow at substantially all fluid levels of the second reservoir.

14. A floor maintenance machine comprising:

a cleaning device for scrubbing contact with a floor;

a fluid feed conduit portion adapted to conduct fluid to the cleaning device;

a first tank;

a first fluid conduit portion connecting the first tank in fluid flow communication with the fluid feed conduit portion;

a gravity-feed flow control device connected in fluid flow communication with the fluid feed conduit portion and operable to control fluid flow to the cleaning device;

a level sensor operable to continuously identify changes in fluid level within the first tank as the fluid level decreases and to generate signals indicative of the identified changes in fluid level; and a controller operably connected to the gravity-feed flow control device and the level sensor and operable to control operation of the gravity-feed flow control device in response to the signals from the level sensor indicating the identified changes in fluid level to provide a substantially uniform flow at substantially all fluid levels of the first tank.

15. The floor maintenance machine of claim 14, wherein the controller regulates an open time of the gravity-feed flow control device based upon the input signals from the level sensor.

16. The floor maintenance machine of claim 15, wherein the gravity-feed flow control device comprises a solenoid valve.

17. The floor maintenance machine of claim 14 further comprising:

a second tank;

a second fluid conduit portion connecting the second tank in fluid flow communication with the fluid feed conduit portion; and a pump connected in fluid flow communication with the second conduit portion and operable to pump fluid from the second tank to the fluid feed conduit portion;

wherein the controller is also operably connected to the pump to control operation of the pump in response to the signals from the level sensor indicating the identified changes in fluid level.

18. The floor maintenance machine of claim 17, wherein the pump comprises a positive displacement pump.

19. The floor maintenance machine of claim 17, wherein the controller is operable to use the signals from the level sensor to maintain a desired ratio of fluids from the first tank and the second tank.

20. The floor maintenance machine of claim 17, wherein the level sensor is operably connected to the controller with a conductor.

21. The floor maintenance machine of claim 20, wherein the controller controls operation of the pump in a frequency modulated operating format.

* * * * *